United States Patent [19]

Winstead

[11] Patent Number: 4,518,096

[45] Date of Patent: May 21, 1985

[54] DRINK-THROUGH CONTAINER LID WITH REMOVABLE DRINK-THROUGH SECTION

[75] Inventor: Thomas W. Winstead, Baltimore, Md.

[73] Assignee: Maryland Cup Corporation, Owings Mills, Md.

[21] Appl. No.: 494,048

[22] Filed: May 12, 1983

[51] Int. Cl.[3] ..... B65D 41/46; B65D 41/48

[52] U.S. Cl. ..... 220/268; 40/307; 206/459; 220/90.4; 220/306; 229/7 R

[58] Field of Search ..... 220/90.2, 90.4, 306, 220/268, 269; 229/7 R, 43; 206/459; 40/307

[56] References Cited

U.S. PATENT DOCUMENTS

| | | | |
|---|---|---|---|
| 1,026,282 | 5/1912 | Schmitt . | |
| 2,152,322 | 3/1939 | Moore . | |
| 2,176,898 | 10/1939 | Fried . | |
| 2,399,241 | 4/1946 | Merkle . | |
| 2,956,721 | 10/1960 | Bennett . | |
| 3,048,317 | 8/1962 | Cochrane et al. | 229/7 S |
| 3,101,870 | 8/1963 | Betner . | |
| 3,227,304 | 1/1966 | Asbury . | |
| 3,301,459 | 1/1967 | Gardner . | |
| 3,335,901 | 8/1967 | Edwards . | |
| 3,362,569 | 1/1968 | Geiger . | |
| 3,392,468 | 7/1968 | Wolf | 40/307 |
| 3,583,596 | 6/1971 | Brewer | 229/43 |
| 3,777,968 | 12/1973 | Law . | |
| 3,800,999 | 4/1974 | Serritella . | |
| 3,868,043 | 2/1975 | Freemyer . | |
| 3,895,743 | 7/1975 | Christian . | |
| 3,927,794 | 12/1975 | Erdman . | |
| 3,933,264 | 1/1976 | Rossi . | |
| 3,994,411 | 11/1976 | Elfelt et al. . | |
| 4,056,210 | 11/1977 | Boyle | 220/90.4 |
| 4,090,660 | 5/1978 | Schram et al. . | |
| 4,106,660 | 8/1978 | Boyle . | |
| 4,187,954 | 2/1980 | Striggow . | |
| 4,202,459 | 5/1980 | DeParales et al. . | |
| 4,202,461 | 5/1980 | Sinoto | 220/268 |
| 4,215,793 | 8/1980 | Packard . | |
| 4,319,692 | 3/1982 | Gundlach | 220/268 |
| 4,333,583 | 6/1982 | Montemarano . | |

*Primary Examiner*—Allan N. Shoap

*Attorney, Agent, or Firm*—McDougall, Hersh & Scott

[57] ABSTRACT

A drink-through lid for beverage containers is disclosed in which a pre-scored drink-through section is included which is removable by squeezing gripping surfaces on opposite sides of a score line which fractures the score line and permits the section to be pulled from the lid while causing the score to initiate a tearing action through the peripheral bead cavity of the lid to facilitate such removal. A continuous thermo-forming and scoring process and apparatus are provided to manufacture lids with scored sections having a predictable response to applied squeezing pressure on the gripping surfaces.

4 Claims, 7 Drawing Figures

DRINK-THROUGH CONTAINER LID WITH REMOVABLE DRINK-THROUGH SECTION

FIELD OF THE INVENTION

This invention relates to lids for disposable beverage containers and the like and more particularly to a plastic thermo-formed lid having a replaceable tear-away section therein removable by initially squeezing the lid and subsequently lifting and pulling at the point of squeeze to permit beverages to be consumed from the container by drinking through a tear-away section of the lid without removing the lid therefrom.

BACKGROUND OF THE INVENTION

Hot beverages and the like are constantly being served in environments in which an accidental spill can result in a painful injury, property damage and other undesirable results.

For example, on airlines, trains and the like, it is customary to serve both hot and cold beverages to passengers. Quite often, these beverages are served in disposable paper or plastic drinking cups or containers which may or may not be provided with lids to retain the heat in the hot drinks or provide a straw slot for the cold drinks. A similar environment exists in various other passenger vehicles in which such drinks are consumed while the vehicle is in motion thereby rendering the beverage susceptible to spilling.

In the prior art such as in U.S. Pat. No. 4,056,210 of Patrick T. Boyle, issued Nov. 1, 1977, for Splash-Proof Drink-Through Beverage Container Lid, and U.S. Pat. No. 4,106,660 of Patrick T. Boyle, issued Aug. 15, 1978, for Splash-Proof Drink-Through Beverage Container Lid, such drink-through cup lids generally similar to the type embodying the present invention have been fabricated from polystyrene sheet or foam material or the like, such as polypropylene sheet, using standard thermo-forming procedures.

Both of the prior art efforts embodied in the foregoing patents of Patrick T. Boyle are characterized by the use of score lines or partial cuts defining the tear-away segment and placed within the confines of the central web of the lid such that upward and outward tearing at those score lines by the insertion of a fingernail or the like through a given one of the score lines results in further tearing of the bead cavity and outer skirt of the lid such that a full generally pie shaped section is torn from the lid and can be replaced by pressing the bead cavity portion thereof back over the top rim or bead of the container from which it has just been removed.

Because of the extent of cut-through in the scoring utilized in these configurations, there is a tendency for some seepage to occur if the containers on which these lids are placed happen to be inadvertently overturned prior to the removal of the tear-away sections therefrom. Also it is required that a fingernail or finger tip be inserted through the scored areas to grip the tear-away sections for removal.

Accordingly, it is an object of the present invention to provide an improved drink-through beverage container lid having a pre-scored configuration without cut-through and a structural configuration providing the rupturing of the score lines by squeezing between the thumb and forefinger of the user to initiate removal of a wedge-shaped drink-through section from the lid which is ultimately replaceable on the container at that portion of the rim of the container from which it has previously been removed.

Yet another object of the present invention is to provide a method and apparatus for reliably and accurately manufacturing such lids so that the behavior of the score lines is predictable.

These and other objects of the present invention become more fully apparent with reference to the following specification and drawings which relate to a preferred embodiment of the lid of the present invention as well as the method of manufacture.

SUMMARY OF THE INVENTION

The drink-through beverage lid of the present invention is made from polystyrene or polypropylene sheet or foam material using standard thermo-forming procedures. The central portion of the lid is in a spider configuration with inverted hollow channels defining raised portions therein of at least the same as or slightly greater height level than the top of the peripheral bead cavity defining the container engaging portion of the lid. The inverted channels comprising the spider are relieved by transverse grooves in their outboard ends immediately adjacent the inner wall of the peripheral bead cavity of the lid to break the continuity of the uppermost surfaces of the lid for stacking purposes and permit sufficient flexure in the bead cavity to facilitate fitting and removal from an underlying container bead (top curl). Interspersed with the various inverted channels of the reinforced spider configuration are depressed areas comprising cavities constituting the balance of the central web portion of the lid which cavities may include, for example, letter codes indicating whether cream, sugar, cream and sugar, or uncut beverage such as black coffee are contained within the container bearing a particular lid.

Along a diameter of the lid defined through a first radius by an inverted channel shape, and within the remaining second radius of that diameter extending from the center, towards the outboard edge of the central panel and web are two adjacent cavities, one inboard cavity commencing at the uppermost portion at the center of the lid and ramping downward to abut a rising, sloping, finger-engaging first gripping surface and a second outboard cavity having a generally semi-circular shape extending inwardly from a subtended portion of the bead cavity into a position adjacent the sloping floored cavity to form a second relatively steeper finger-engaging semi-circular gripping surface portion adjacent to and opposed to the first finger-engaging gripping surface portion across an arcuate ridge defined between the adjacent cavities within the raised central web portion. This generally arcuate ridge surface is scored, preferably from the inside of the central web portion, from the inboard edge of the bead cavity through the generally arcuate path of the ridge and back to the other inboard edge of the bead cavity subtending the said substantially semi-circular depressed cavity in the lid.

A score line is thus defined such that when the first and second finger-engaging gripping surfaces are squeezed by the forefinger and thumb, respectively, of a user, or vice versa as the case may be, the score line will rupture. Then, by applying a lifting action on the second finger-engaging wall, the score line, and second finger-engaging wall and the entire semi-circular cavity defined therein may be lifted upward and outward from the central web portion thereby tearing through the bead cavity and the outer skirt portion of the bead cavity to remove the entire semi-circular cavity up to the score line as a generally semi-circular shaped removable drink-through section. This drink-through section may be replaced on the container by fitting that arcuate portion of the bead cavity attached thereto over the exposed section of the top curl (bead) of the underlying container which had previously been exposed by removing the drink-through section.

The score line is placed in the interior of the central web of the lid along the arcuate ridge formed therein by a continuous rotary molding process in which downstream from the molding step there is a rotary scoring roll and anvil roll by which extremely accurate score lines can be cut into the interior of the web along the arcuate ridge described to within a predetermined and accurately controllable distance of the upper surface of the web. Thus fracturing upon squeezing can be assured in response to normal finger pressure.

DETAILED DESCRIPTION OF THE DRAWINGS

Figure 1:
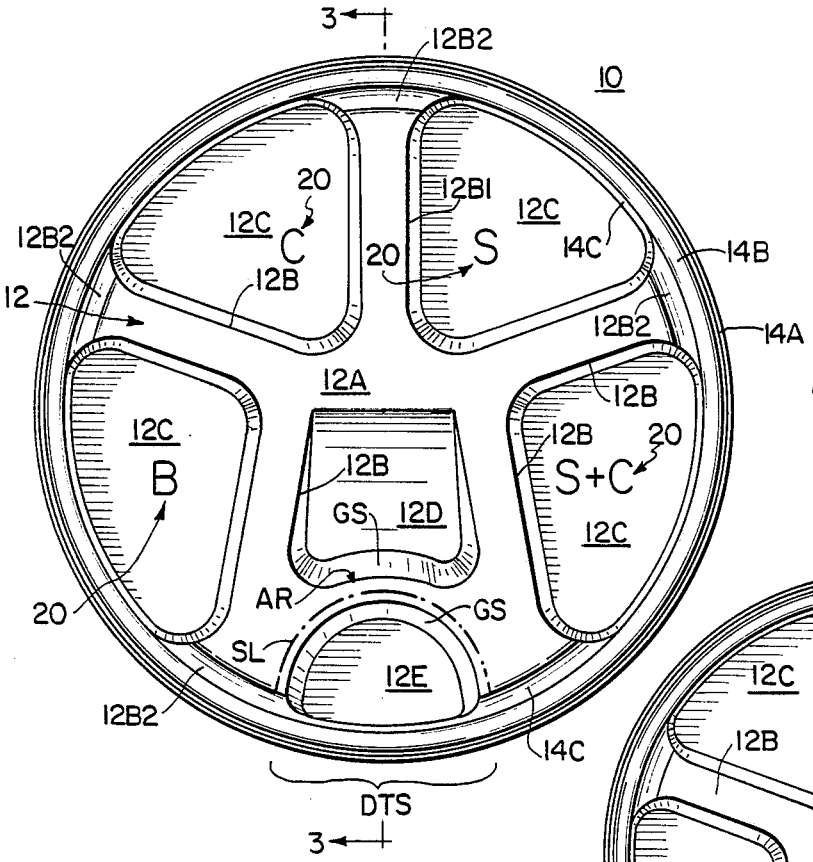
FIG. 1 is a top plan view of a preferred embodiment of the beverage container lid of the present invention.
Figure 2:
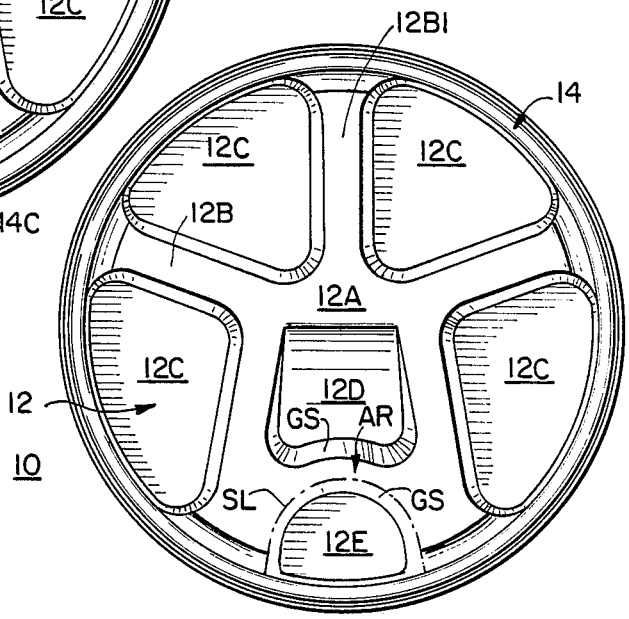
FIG. 2 is a bottom plan view of the beverage container lid of FIG. 1.
Figure 3:
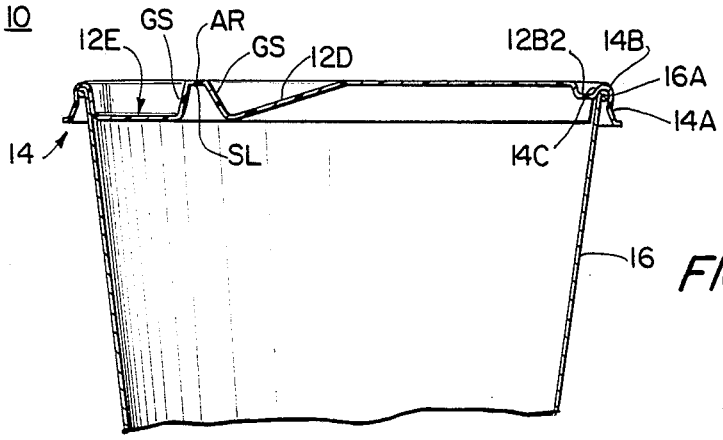
FIG. 3 is a cross-section taken along line 3—3 of FIG. 1.

Referring in detail to the drawings and with particular reference to FIGS. 1, 2 and 3, a container lid 10 of the present invention is shown as including a central web portion 12 comprised of a raised spider configuration 12A formed from inverted U-shaped channels 12B interspersed with depressed cavity portions 12C.

A diametric array comprised of a radial channel 12Bl, a ramp based inboard cavity 12D, and a flat based substantially semi-circular outboard cavity 12E is provided with an arcuate ridge AR defined between the said inboard and outboard cavities 12D and 12E, respectively, whereby outboard of that ridge the substantially semi-circular outboard cavity defines the removable drink-through section DTS of the lid 12. This removable drink-through section DTS is further defined by a score line SL within the said arcuate ridge AR. On either side of the arcuate ridge AR are gripping surfaces GS extending downwardly into the respective inboard and outboard cavities 12D and 12E such that the gripping surfaces GS may be squeezed with the fingers towards one another to thereby fracture the score line SL and permit the entire outboard cavity 12E and that portion of the arcuate ridge AR outboard of the score line SL to be lifted upwardly and outwardly from the lid causing tearing through of the peripheral bead cavity 14. The bead cavity 14 includes an outer skirt 14A, a top surface 14B, and an interior wall portion 14C, all three of which tear through based upon the line-of-tear established by the fractured score line SL in response to an upward and outward pull on the removable drink-through section DTS defined by the cavity 12E and score line SL.

The outboard ends of the various inverted channels 12B are provided with relieved arcuate troughs 12B2 immediately adjacent the inner wall portion 14C of the bead cavities 14 to provide sufficient flexure of the bead cavities 14 to effect a facile snap fit with an underlying container bead 16A such as that of the container 16 shown in FIG. 3.

Figure 4:
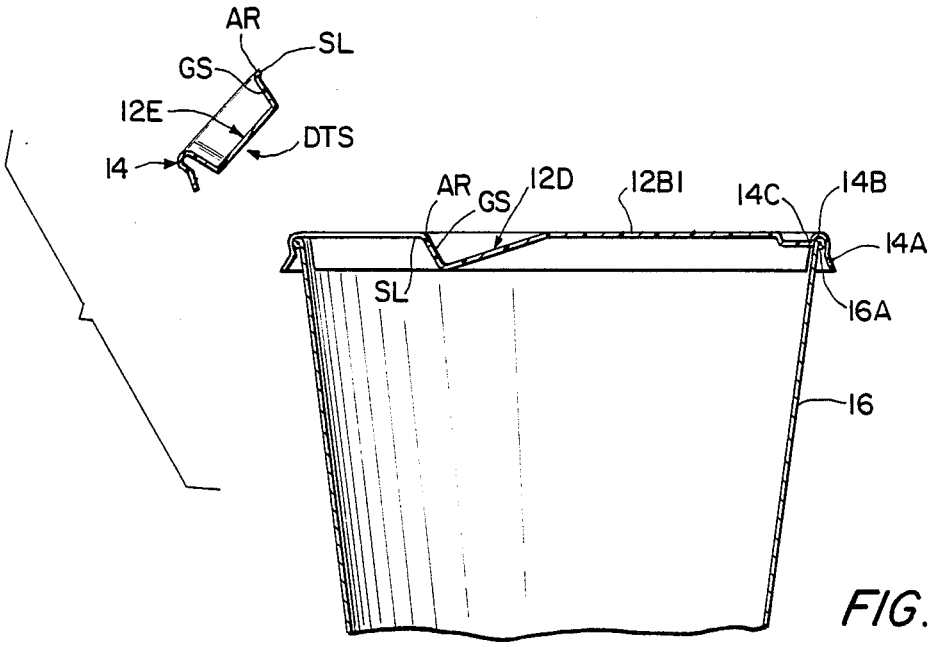
FIG. 4 is the cross-section of FIG. 3 illustrating the removal of the drink-through section of the present invention.
Figure 5:
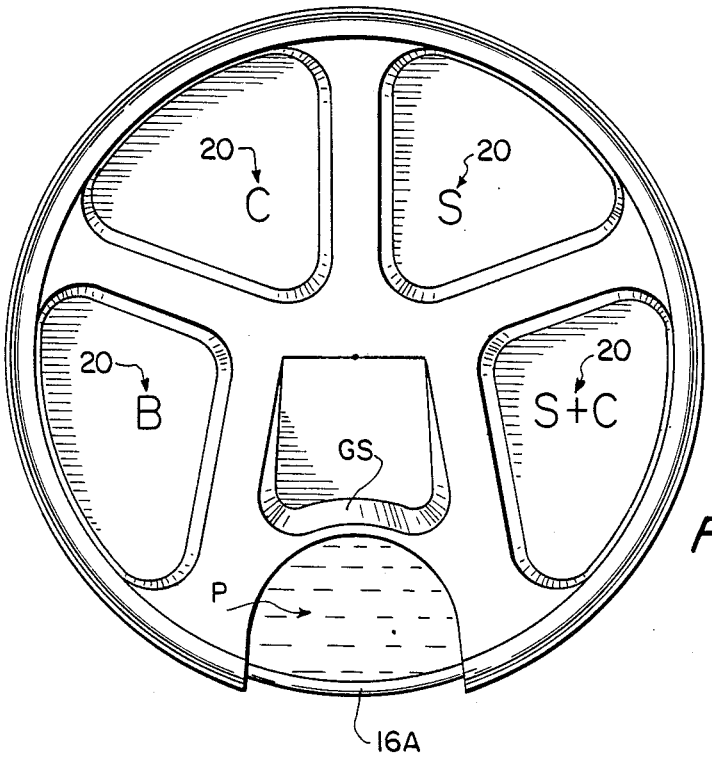
FIG. 5 is a top plan view of the beverage container lid of the present invention on a beverage container with the drink-through section removed.

As shown in FIGS. 4 and 5, the drink-through section DTS has been completely removed from the bead 16A of the container 16 upon which it may be replaced, if desired, because of the section of bead cavity 14 remaining thereon. This section of bead cavity 14 may be fitted back over the bead 16A of the container 16 to replace the drink-through section DTS within the lid 10 until such time as additional beverage is to be consumed through the port P illustrated in FIG. 5 as effected by the removal of the drink-through section DTS. Contents indicia 20 such as the letters C (cream), S (sugar), S+C (sugar and cream) and B (black) are illustrated in FIGS. 1 and 5.

The depth of the score line SL is preferably controlled to close tolerances such that a predictable fracturing and tearing along the score lines can be effected in mass production of the lid 10.

Figure 6:
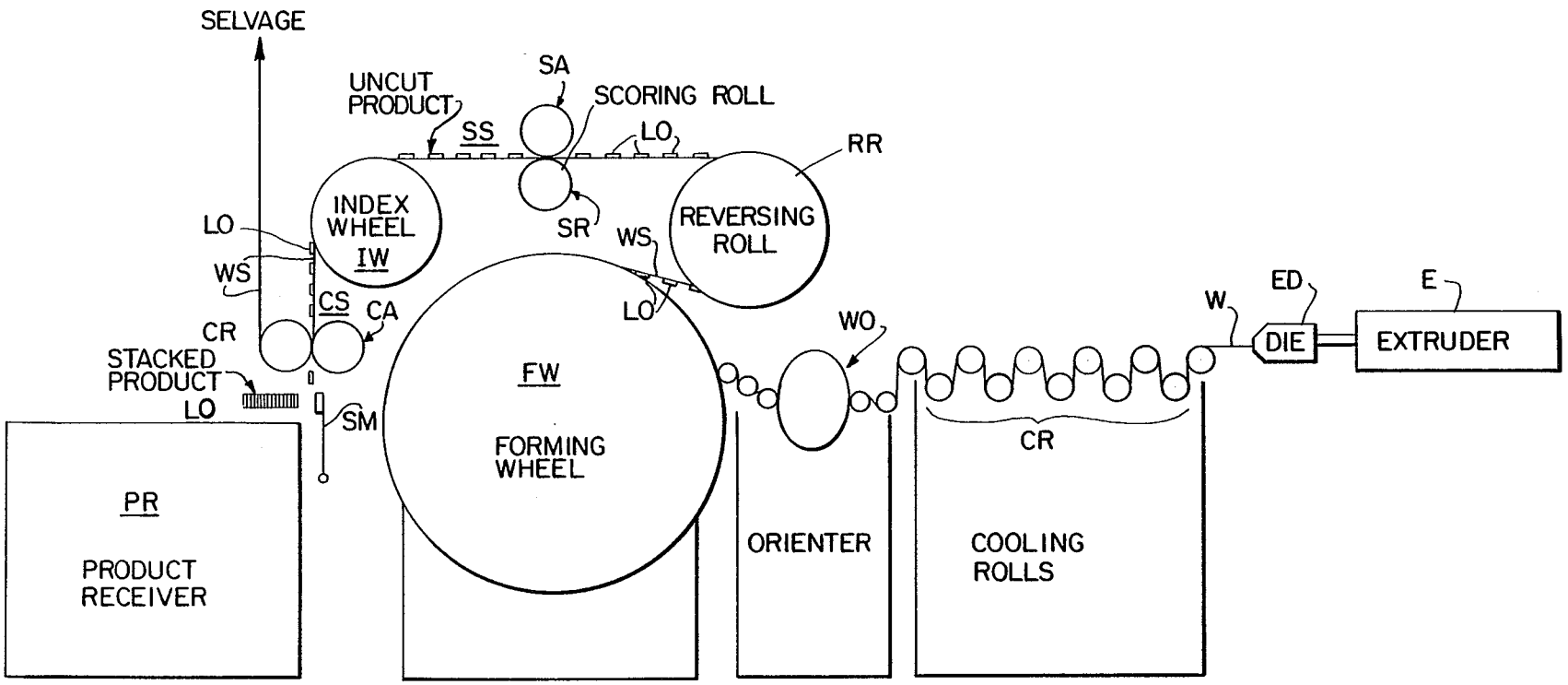
FIG. 6 is a schematic illustration of a method and apparatus for manufacturing the drink-through beverage container lid of the present invention.

Referring next to FIG. 6, a continuous extrusion thermo-forming and scoring process and apparatus are schematically illustrated for mass producing the lids 10 of the present invention and providing therein score lines SL of accurate depth from the upper surface, preferably, of the lids 10 such that predictable fracturing and tearing to provide removal of the drink-through sections DTS is accomplished.

The score line SL may be formed from the inside surface or from the outside surface of the arcuate ridge AR. Advantageously, the ridge AR is scored from the inside surface. This leaves the outer surface free from lines or marks until the score line SL is broken and the drink-through section DST has been removed.

Figure 7:
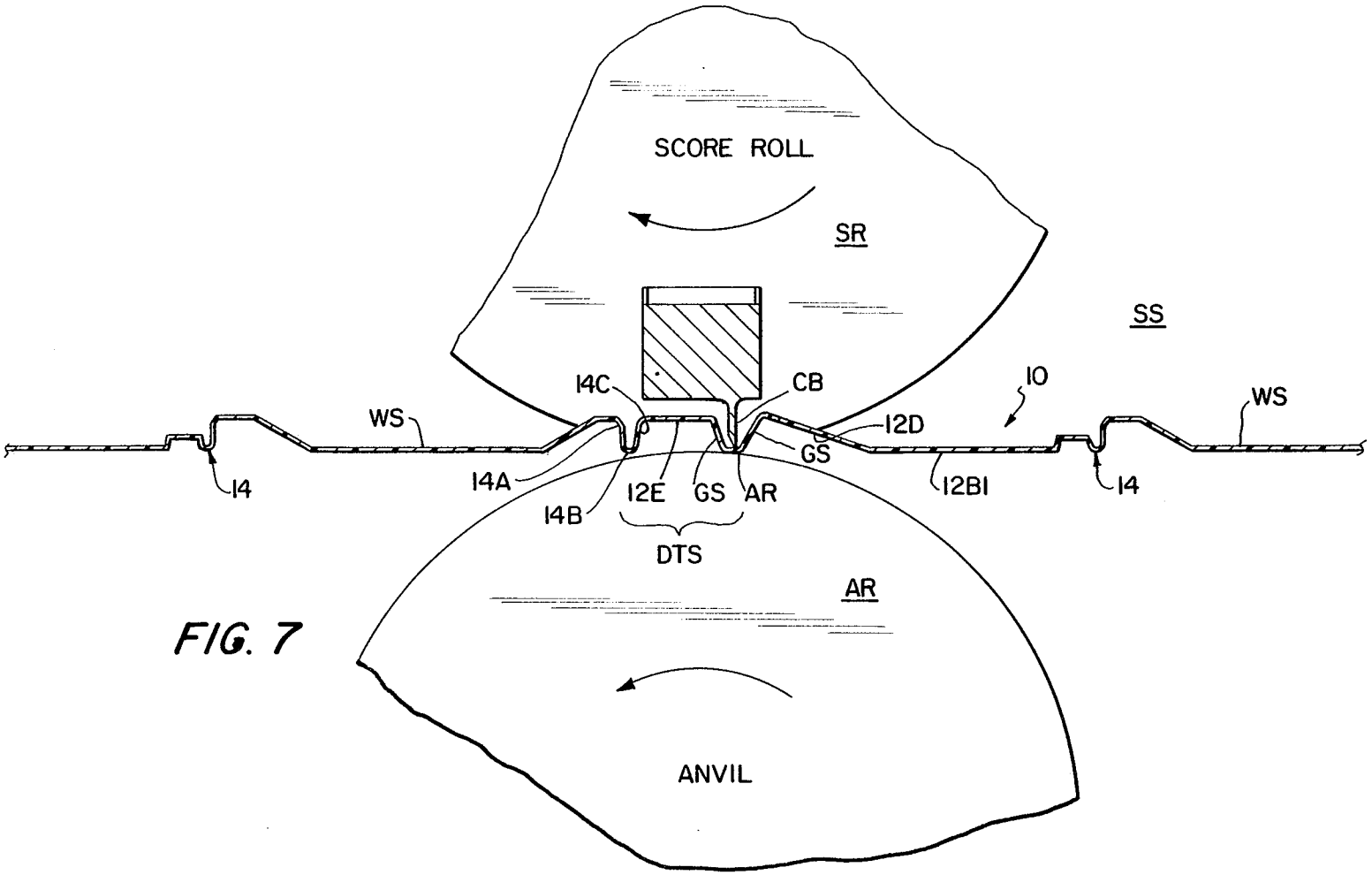
FIG. 7 is a schematic illustration of a rotary scoring roll and anvil providing a score line in a thermo-formed lid of the present invention.

The score line SL should be shaped to encourage rupture such as by an inverted "V" shape for an interior score line as illustrated in FIG. 7. This accentuates the effect of squeezing the inboard and outboard gripping surfaces GS on opposite sides of the arcuate ridge AR towards one another to cause upset and rupture of the ridge along the score line SL.

A depth of scoring which leaves from one (1) to five (5) mils thickness between the outer surface of the arcuate ridge AR of the lid 10 and the apex of the score line has been found to provide a satisfactory rupturable score line SL for the purpose of the present invention in lids formed of biaxially oriented and non-oriented polystyrene and polypropylene.

A lid 10 in ccordance with the present invention may be formed from, for example, polystyrene or polypropylene, using, for example, the thermo-forming processes and apparatus of FIGS. 6 and 7. Once the lid 10 is formed, the score line SL may be cut into the arcuate ridge AR as illustrated in more detail in FIG. 7. This may be accomplished by, for example, passing the formed lid 10 between a scoring roll SR and an opposed anvil roll SA.

As illustrated, a thermoplastic web W of polystyrene, polypropylene or the like is extruded from the extrusion die ED of an extruder E and passed through cooling rolls CR which bring the web W to a desired thermoforming and orienting temperature where such orientation is desired. Orienting is illustrated in the present embodiment by way of example. Downstream from the cooling rolls CR the web W is biaxially oriented in the web orienter WO and then reeved about the thermoforming mold wheel FW to form the lids 10 in the web W. The web selvage WS and attached thermo-formed lids 10 are stripped from the forming wheel FW by means of a reversing roll RR and passed through a scoring station SS comprised of a scoring anvil roll SA and scoring roll SR to place the score line SL in the arcuate ridge AR of the formed lids 10.

Thereafter, the scored lids 10 are passed over an index wheel IW while still entrained in the web selvage WS and passed through a cutting station CS comprised of a cutting anvil roll CA and a cutting roll CR which severs the scored lids 10 from the web selvage WS and permits them to be stacked for subsequent packing and handling by a suitable stacking mechanism SM at a product receiver station PR.

As shown in more detail in FIG. 8, the scoring station SS has cutter blade assemblies CB mounted on the periphery of the scoring roll SR acting against the periphery of the scoring anvil roll SA to form the score line SL internally of the arcuate ridge AR of the lid 10. The reversal of position of the two rolls relative to the lid 10 will result in the score line SL being formed externally of the arcuate ridge AR of the lid 10.

While the invention has been described with reference to the accompanying drawings, it is not limited to the details and specific features shown therein as obvious modifications may be made by those of ordinary skill in the art. The scope of the present invention is limited only by the claims appended hereto.

We claim:

1. A flexible plastic lid means for open-mouthed containers having a peripheral bead or rim defining the open mouth thereof, comprising:

a rim receiving peripheral bead cavity means formed in the outer periphery of said lid for engaging the peripheral bead of a said container and retaining said lid means thereon;

central web means bounded by said bead cavity means for overlying the open mouth of a said container and having a raised area defined therein; and finite score line means including a score line formed in said raised area and oriented therein to subtend a given peripheral portion of said bead cavity means, the configuration of said score line means substantially defining the boundaries of a tear-away drink-through section in said lid means extending inboard of said bead cavity means;

said score line means including gripping means defined by surfaces disposed on opposite sides of said score line and forming at least a part of said raised area and also being disposed in spaced-apart relationship with said rim and radially inwardly of said rim for applying a squeezing force transversely of said score line at a location remote from said rim, said score line means being responsive to said squeezing force so applied to fracture said score line and render said tear-away drink-through section removable from said lid means by way of predictable fracture of said score line in response to a pulling force subsequently applied to said gripping surfaces adjoining said drink-through section;

first and second depressed cavity means defined in said raised area and mutually bounded over a portion of said finite score line means to define said gripping surfaces; and wherein said gripping means comprises upstanding first and second surface means defined in said first and second depressed cavity means, respectively, on opposite sides of said score line in the provision of a ridged shape to that portion of said score line means.

2. A flexible plastic lid means as set forth in claim 1, wherein said first cavity means is inboard of said second cavity means and said portion of said score line means mutually bounding said cavity means is in the configuration of an arcuate ridge having an upper surface between said gripping means and having said score line defined in the said upper surface.

3. A flexible plastic lid means as set forth in claim 1, wherein said raised area comprises a spider configuration of inverted channels shapes extending from the central area thereof outboard to a position adjacent said bead cavity means;

said channels being provided with transverse trough means defined therein immediately adjacent said bead cavity means to enhance flexibility of the latter.

4. A flexible plastic lid means as set forth in claim 3, wherein additional depressed cavity means are provided intermediate adjacent channels in said spider configuration;

said additional cavity means including indicia means for indicating the contents of a container associated with said lid means.

* * * * *